United States Patent [19]

Inagaki

[11] Patent Number: 4,971,194

[45] Date of Patent: Nov. 20, 1990

[54] GARMENT COVER WITH NECKTIE HANGER

[76] Inventor: Jitsuo Inagaki, 71, Aza Kamiyashiki, Oaza Itsusiki, Itsusikicho, Hazugun, Aichi, Japan

[21] Appl. No.: 455,926

[22] Filed: Dec. 29, 1989

[51] Int. Cl.[5] ..... A45C 3/00; B65D 65/02; B65D 85/18

[52] U.S. Cl. ..... 206/292; 206/278; 383/117

[58] Field of Search ..... 206/279–292, 206/278; 383/117, 102; 190/111; 229/87.15

[56] References Cited

U.S. PATENT DOCUMENTS

| | | | |
|---|---|---|---|
| 1,604,090 | 10/1926 | Wolfson | 206/292 X |
| 1,651,706 | 12/1927 | Holbrook | 206/287 |
| 1,652,269 | 12/1927 | Bremner | 206/278.1 X |
| 1,914,087 | 6/1933 | Gilmore | 190/111 |
| 2,022,560 | 11/1935 | Fjellman | 383/102 |
| 2,087,211 | 7/1937 | Marbury et al. | 206/287.1 X |
| 2,322,601 | 6/1943 | Strauss | 206/286 X |
| 2,380,375 | 7/1945 | Axelrod | 206/286 X |
| 2,895,521 | 7/1959 | Weber | 206/292 |
| 2,935,182 | 5/1960 | Cater | 206/285 |
| 3,809,194 | 5/1974 | Chappelle et al. | 206/287 |
| 4,580,667 | 4/1986 | Herwood | 383/117 X |

FOREIGN PATENT DOCUMENTS

| | | | |
|---|---|---|---|
| 440673 | 1/1936 | United Kingdom | 206/287 |
| 819661 | 9/1959 | United Kingdom | 206/292 |

*Primary Examiner*—Sue A. Weaver
*Attorney, Agent, or Firm*—Donald W. Hanson

[57] ABSTRACT

This invention is intended to provide a garment cover that can protect a garment such as a suit against deformation and formation of wrinkles and creases while it is kept in a traveling suit case during a trip.

A garment cover according to the invention is characterized by that it is made of synthetic resin coated meshy cloth and realized in a form having separable front edges.

3 Claims, 2 Drawing Sheets

GARMENT COVER WITH NECKTIE HANGER

This application is a continuation of application Ser. No. 312,827, filed Feb. 21, 1989.

BACKGROUND OF THE INVENTION

This invention relates to a garment cover that can conveniently protect a garment such as a suit along with accessories such as neckties when carried in a traveler's suitcase without deforming the contents and forming any wrinkles or unintended creases in the contents.

When a traveler is making a long trip to overseas countries on business, for sightseeing or other purposes, he or she may want to carry with him or her a change of suits and/other garments. However, it is normally extremely cumbersome and time consuming to encase such spare clothes so that they are free from wrinkles and creases during a journey. Moreover, neckties which are encased in a traveling suitcase can be easily wrinkled or creased under the pressure of the other objects filled in the case.

SUMMARY OF THE INVENTION

It is therefore an object of the invention to provide a garment cover that can conveniently protect a garment such as a suit against deformation when carried in a traveler's suitcase It is another object of the invention to provide a garment cover that can hold neckties and other accessories without forming creases in them.

Other objects as well as advantages of the invention will become apparent from the following description which is made by referring to the accompanying drawings that illustrate a preferred embodiment of the invention.

BRIEF DESCRIPTION OF THE INVENTION

In the accompanying drawings:

FIG. 1(*a*) is a front view of an embodiment of the invention while FIG. 1(*b*) is a back view of the embodiment of FIG. 1(*a*); and FIG. 2 is a front view of the embodiment of FIG. 1(*a*) illustrating the condition when it is in use.

DETAILED DESCRIPTION OF THE INVENTION

The above objects of the invention are achieved by providing a garment cover made of meshy cloth coated with synthetic resin and having front wrapped portions that can be removably attached together.

A garment cover according to the invention which is made of synthetic resin coated meshy cloth is advantageous in that it can keep its original form and at the same time effectively hold the garment in it because of the friction it exerts on the garment since it has a large frictional area throughout its total surface as there are a large number of openings and the surrounding edges on the cloth to which the garment is exposed. The friction between the cloth and the garment restricts any movement of the garment and significantly contributes to keep the original shape of the garment without forming wrinkles and/or creases in it.

Now the prevent invention will be described in detail by way of an embodiment thereof.

Figure 1:
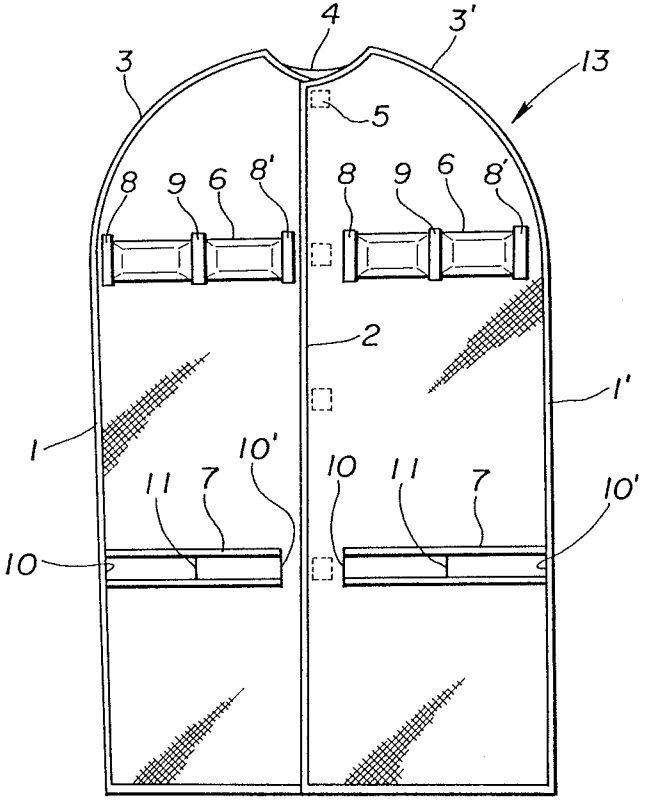
Figure 1:
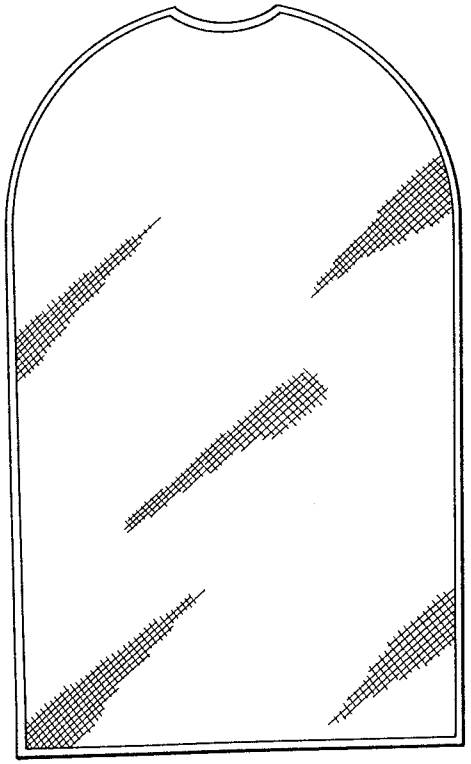

FIG. 1(*a*) is a front view of an embodiment of the invention in which a garment cover 13 is made by sewing together the lateral edges 1, 1' of the back and the right and left front halves respectively of the cover made of a meshy cloth. The cover 13 is made such that the front edges of the right and left front halves are separated from each other and their respective upper edges 3, 3, forms the profile of a shoulder having a top opening 4 at the center.

The separable front edges 2 are removably connected together by means of a number of Velcro fasteners (magic tape pieces) 5.

On the upper portion of the garment cover 13 are provided a pair of necktie hangers 6, each of which is made by stuffing a meshy bag with a oblong sponge and fitted by sewing to the left or front cover half at its lateral edges 8, 8' and at center 9. There are also provided a pair of necktie holders 7 on the lower portion of the garment cover 13, each of which is fitted by sewing either to the separable left or right front cover half at its lateral edges 10, 10' and center 11.

A garment cover according to the present invention can be used in the following manner.

Figure 2:
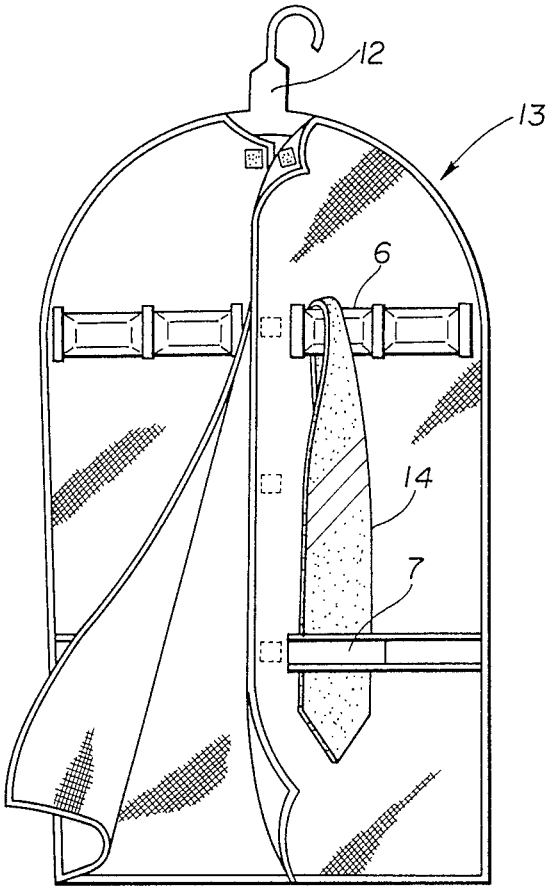

As shown in FIG. 2, a suit hung on a hanger 12 is placed inside a garment cover 13 according to the invention and the front edges 2 are bound together by means of a number of Velcro fasteners 5. A necktie 14 may be folded into two halves and the upper end may be passed through the inside of one of the necktie hangers 6 so that it is hung by the hangers, while the lower end of the necktie 14 may be held between the corresponding necktie holder 7 and the surface of the meshy cloth opposite to the holder. Then the garment cover may be placed into a traveling suitcase just as it is.

Since a garment cover according to the invention is made of synthetic resin coated meshy cloth, the garment which is contained within the cover can be held to its original shape by a strong friction that characterizes the material so that it can be conveniently used to cover a garment such as a suit in a traveling suitcase without deforming the garment or forming wrinkles and/or creases throughout a long trip. Moreover, since a necktie can be held in it in a condition where it is folded about a sponge, it is also free from formation of wrinkles and creases.

What is claimed is:

1. A garment cover made of synthetic resin coated meshy cloth having a large number of openings therein providing a large frictional area throughout its total surface so that the friction between the cloth and the garment restricts any movement of the garment, said cover in the form of a cylinder having a top and a bottom which is separable along a front axial line on the periphery thereof, said garment cover having an opening formed at the top of the cover to allow a hook of a garment hanger to project therefrom, the bottom of the cover being totally open.

2. A garment cover according to claim 1, wherein a necktie hanger made of spongy material is securely fastened at both its ends to the garment cover such that a narrow passageway for a necktie is formed between it and the garment cover.

3. A garment cover according to claim 2, wherein the necktie hanger is formed by encasing the spongy material in a meshy bag.

* * * * *